United States Patent [19]

Varges et al.

[11] 3,939,790

[45] Feb. 24, 1976

[54] TRANSPORT SHIP CONSTRUCTION AND METHOD OF LOADING FLOATING CARGO INTO A FLOATABLE CARGO SPACE OF A SHIP

[75] Inventors: Günter Varges, Emden; Franz Graalmann, Leer, both of Germany

[73] Assignee: Rheinstahl Aktiengesellschaft, Germany

[22] Filed: Mar. 13, 1973

[21] Appl. No.: 340,812

[30] Foreign Application Priority Data

Mar. 23, 1972 Germany ..... 2214177

[52] U.S. Cl. ..... 114/43.5 VC

[51] Int. Cl.[2] ..... B63B 35/40

[58] Field of Search ..... 114/43.5 VC, 72, 73, 75, 114/76

[56] References Cited

UNITED STATES PATENTS

| | | | |
|---|---|---|---|
| 1,107,741 | 8/1914 | Ballin et al. | 114/72 |
| 2,608,167 | 8/1952 | Harris | 114/75 |
| 3,191,568 | 6/1965 | Schroeder et al. | 114/43.5 |
| 3,318,276 | 5/1967 | Nemec | 114/43.5 |
| 3,537,413 | 10/1969 | Farrell | 114/43.5 |
| 3,624,736 | 11/1971 | Iwami | 114/72 |

FOREIGN PATENTS OR APPLICATIONS

| | | | |
|---|---|---|---|
| 83,914 | 1971 | Germany | 114/43.5 |
| 1,930,771 | 4/1971 | Germany | 114/43.5 |
| 1,345,592 | 11/1963 | France | 114/43.5 |

*Primary Examiner*—George E. A. Halvosa
*Assistant Examiner*—Sherman D. Basinger
*Attorney, Agent, or Firm*—McGlew and Tuttle

[57] ABSTRACT

A transport ship for transporting floatable cargo comprises a hull having a ballast system with a plurality of ballast tanks and with at least one cargo space which is capable of being flooded. The cargo space is closed by at least one sea door. The ballast system is capable of flooding the cargo space and adjusting the ballast of the hull in order to bring the water level of the cargo space level with the surrounding sea so that the sea doors may be opened and the floatable cargo may be floated directly into the cargo space. With the method of the invention, after the vessel is ballasted and the cargo space flooded in order to adjust the level of the cargo space water to the surrounding water level the sea doors are opened and the cargo floated into the space and aligned in stowage position. The water level is then adjusted in order to either lower the cargo to position it in a secured position in which further elements are anchored to the individual cargo elements or containers; or the level in the cargo space is raised even higher in order to position the cargo into an upper tier stowage position. In the upper tier stowage position hanging devices are provided for securing the cargo and/or holding it in the upper tier position. A plurality of tiers may be loaded in this manner by successively loading the vessel from the uppermost tier downwardly. Intermediate tiers are supported preferably by holding elements which are moved outwardly from the sides of the cargo space. These may comprise extendable brackets which are carried in the bulkhead walls running along the sides of the cargo space. After each whole tier length of cargo is pushed into the cargo space the sea water is adjusted to locate the cargo in a stowage position and then the cargo is secured in that position. Thereafter the level of the water in the cargo space is again adjusted and if more than one tier is to be loaded it is adjusted downwardly to float the next level or cargo in below the upper tier level. Each tier level of a cargo space is floated in along the complete length or selected parts of that cargo space at a time, and the individual cargo elements are secured in position before the adjustment of the ballasting in the cargo space is effected.

35 Claims, 2 Drawing Figures

TRANSPORT SHIP CONSTRUCTION AND METHOD OF LOADING FLOATING CARGO INTO A FLOATABLE CARGO SPACE OF A SHIP

BACKGROUND OF THE INVENTION

1. FIELD OF THE INVENTION

This invention relates in general to the construction of transport ships and in particular to a new and useful transport ship for handling floating cargo and to an improved method of loading the floating cargo.

2. DESCRIPTION OF THE PRIOR ART

Transport ships for carrying floating cargo are known and are referred to as lash ships and as barge carriers. The loading and discharging of floating containers or vessels with such ships is as a rule done on free water by shipborne lifting devices which pick up the floating vessels from the water for transfer to the ship and vice versa. Such expensive shipborne lifting devices have the common disadvantage that they require an assembly of a large number of individual parts with a relatively low degree of reliability and in most cases the loading and unloading operations are impaired by the sea water conditions and the atmospheric environment of the ship. A further disadvantage is that such vessels usually have to be operated by shore side personnel because of the prevailing agreements between ship owners and longshoremen unions. Such personnel are normally unable to operate such gear as carefully and safely as a trained crew of the ship. In addition with the use of travelling ship cranes for the handling of floating vessels, the cranes sensitivity to the ship's inclination is a further disadvantage.

So-called float in and float off ships are also known in which the floating cargo is floated into the ship's cargo space in superposed tiers in order to avoid the disadvantages of the use of ship borne lifting devices. A disadvantage of this arrangement is however that the ship must be lowered for each tier to an immersion of the ship which allows the floating vessels to be stowed into a stowage level vertically fixed within the ship. In addition they must be adjusted to fix deck or girder structures which segregate the cargo containers at various cargo levels. With such ships the height of the stowage spaces for each tier of floating cargo or floating containers has to be increased beyond and above the height of the floating vessels by an amount which results from the height differential between the light and deep load line of the floating vessels from the upper and lower safety margin in order to allow an undisturbed and accident free float in an float off of the vessels and from the requisite height to accommodate the structures of the ship which segregate the cargo levels. This results in the creation of a dead space in each cargo level above each settled tier of floating vessels and this requires that the depth of the transport ship be increased by this height differential for each tier of the floating vessels. The increased depth of the ship results in an increased ship's weight. This also requires that the ship's beam to be increased in order to maintain sufficient stability against capsizing of the ship. The increased beam again results in further increased ship's weight and all of this additional weight requires additional propulsive power. Therefore, the known ships of this type become more expensive in construction as well as in operation.

The water depth requisite to accommodate such a ship when docking or releasing the floating vessels increases with the ship's depth. Thus, this limits the employment possibilities or prohibits the employment of such a ship precisely where the cargo loading and discharging has to be carried out that is in the coastal waters and as a rule restricts the use of the ships in respect to the depth of such waters.

SUMMARY OF THE INVENTION

The disadvantages of the known transport ships are overcome by providing a transport ship which has a cargo space which may be flooded and which includes an improved tier stowage system for the individual cargo which permits the loading of the ship by floating each tier into position and by ballasting the space to permit anchoring of the floated tier at a desired holding level. The construction provides a ship which has a lower water depth requirement when either loading or discharging and the floating cargo can be loaded and discharged in a more economic simpler as well as technically feasible and safe arrangement without requiring lifting devices which are operated by shipside personnel.

The cargo hold is designed as a floodable dock chamber inside which the floating containers or vessels can be moved vertically from the level of the lowest tier to that of the uppermost tier by carrying out flooding operations. The flooding operations can be executed either with the dock chamber communicating with the outside sea water similar to a floating dock by lifting or lowering the whole ship by ballasting operations or with the dock chamber closed by sea doors and the level therein controlled by flooding or draining the dock chamber.

In accordance with the method of the invention, the vessel is ballasted to flood the cargo space and to adjust the level of the water therein to the level of the sea. The first and uppermost tier of floating cargo is then pushed into the cargo space and either the ship water line level is adjusted or the water level in the cargo space is adjusted to position the first tier in the uppermost securing or stowage level. The floating cargo is then secured at the level in the proper orientation along the complete length of the cargo stowage space. The vessel and/or the floodable cargo space are de-ballasted and the level of the water in the dock is adjusted to permit the next lower level to be floated in below the first level. This second tier may be secured within a small spacing from the floating vessels which are already stowed above in a first tier. After the second tier is secured additional tiers may be floated in down to the lowermost level of the cargo space.

The ship constructed in accordance with the invention has an advantage over the known float in and float off ships in the following respects:

With the vessel of the invention which for instance is intended to transport two tiers of the known LASH barges the saving in height compared with corresponding ships of the float-in and float-off type lies in the range of about three and one half to four meters. When the ships accommodate either three or four tiers the savings in height will double and triple respectively. The reduction in depth on account of the saving in height will in addition result in reduction of the requisite depth of water which is necessary for the docking procedures when handling the floating vessel and in a corresponding amount and this is obviously a decisive advantage since the handling will take place in coastal waters. In addition, the quantity of water ballast which has to be handled will be less and this in turn results in another economy in construction and operation due to a reduction in size of the ballast pumps and the ballast piping systems which are necessary.

In the embodiment wherein the cargo space is sealed off from the sea water by closable sea doors the dock space itself may be changed in respect to water level independently of the draft of the ship. Such a construction insures that the draft necessary for the loading operation may be reduced. With such a construction the ballast water may be taken from the ballast tanks of the ship or water from the sea may be used separately or at the same time. The draft of the transport ship itself will either remain unaltered or will become only insignificantly deeper when the dock chamber itself is ballasted, either from the ballasting tanks of the ship or from the outside sea water.

The ship of the invention advantageously includes a single sea door opening for example at the bow of the ship however when several floating openings are employed they are all arranged at the same level.

In order to provide space saving stowage of the floating cargo the uppermost tier stowage space includes hanging devices which extend below the main deck or weather deck and terminate in a respective dock chamber visible at the weather deck. The hanging devices include means for locking the floating cargo which is moved into position in the uppermost tier by flotation within the cargo space. The transport ship advantageously also includes inflatable or press on devices which extend outwardly from the side bulkheads bounding each dock chamber. The devices for holding the cargo against transverse movement may for example comprise wedges or pneumatically or hydraulically inflatable hollow bodies arranged in the side walls of the respective dock chamber. A transport ship of this construction is advantageously loaded from a float in opening at one of the ends of the ship because it facilitates the operation of the ship. Such an opening would be closed by water tight movable dock gate elements or doors and perhaps by an additional outer portion of the ship's hull which is favorable streamlined and perhaps arranged out in front of the gate.

During the docking procedure with such ships, the water entering from outboard into a ship's region mainly concentrated toward the open ship's end usually provokes trimming which will have to be equalized by ballasting the opposite ship's end in order to safely float in and float off the floating cargo which is to be loaded and discharged. This additional ballasting will result in an increased demand for depth of water for the loading and unloading procedure. This affect can advantageously be avoided by producing or maintaining buoyancy by appropriate measures at the openable ship's end so that the same trimming effect as resulting from the draft increasing ballasting of the opposite end of the ship can be effected.

The increase in draft of the ship caused during the loading or docking procedure and which is caused by trimming ballast can be avoided by the present invention and in addition a reduction in draught during the docking procedure can even be obtained by the additional buoyancy. The additional buoyancy at the end which is temporarily opened is obtained by the following technical measures described below which are chosen individually or combined depending upon the operating conditions given:

A. By draining the space between the closed inboard dock gate and the removable ship's parts which are arranged in front of the dock gate.

B. By arranging two water tight movable dock gates inside the ship in front of the cargo space and by draining the space between these two gates.

C. By constructing the removable ship's parts in front of the exterior dock gate as water tight hollow bodies which will advantageously remain connected to the rest of the ship after opening in the sense that forces and moments can be transmitted therethrough into the rest of the ship's hull.

In the Examples A and B above the procedure will be inverse when draining the dock chambers from the arrangement described in A and B wherein they are flooded. In case C the trimming moments of a ship with removed removable hull parts which occurs when the dock chambers are being flooded are considerably reduced or wholly avoided since the buoyance of these removed parts of the ship will also increase as the draught for the loading operation increases. A further advantage of the use of hollow parts for the door elements is that these parts are buoyant and this is useful in the operating procedure.

In order to facilitate the guidance of the floating vessels or cargo into the dock chamber, the removable parts of the ship's hull have bell mouth shape construction toward the floating opening and are protected from damage by roller fenders or similar devices.

In accordance with the invention floating vessels or cargo can be floated into or out of the respective dock chamber or cargo chamber by self propelled small water craft such as push boats which may push each unit individually or groups comprising several units or vessels. It is also possible however to have the floating cargo led by small water craft to the float in opening only from where they are pulled into or out of their respective dock chamber while they are floating by means of a ship's winch. The self propelled water craft used for pushing can be docked and carried inside or in front of the dock chamber within the ship. For positive guidance of the floating vessels during the vertical movement after the cargo is floated in or before it is floated off the transport ship carries positioning devices which are movable out of the side walls of each dock chamber and which may be arranged in a predetermined position in respect to the fore and aft direction of the ship. The cargo which is once floated in will be automatically held in a fore and aft position once they are in a location in which they are oriented for stowage by the use of movable catching devices located inside the docking chamber. Such devices are preferably located along the side walls of the dock chamber and also at its entrance. Undesired drifting of the floating vessels once they are floated into the dock chamber and particularly the possibility they may drift out of the transport ship especially where it is taking in the cargo in a fast flowing stream will be avoided or controllably limited. Such automatic catching devices can be used also as positioning devices and will be urged into the dock chamber by a permanent restoring force out of a recess in the longitudinal dock bulkheads. The restoring forces of the automatic catching devices are advantageously produced by the buoyance effects of the dock water action on catching devices constructed as floating bodies or by the influence of their own gravity or are restoring forces produced by machanical, hydraulic or pneumatic springs. Those cathing device parts which protrude into the dock chamber space are wedge, roll or spherically shaped objects to facilitate their being pressed back into dock chamber's recesses by the sides of the floating cargo when this cargo is pressed in or out of the dock chamber by preferably tug push or winch pull. The holding forces are such that they will release articles when push boats or winch forces are employed for moving them in a forward and after direction of the ship. Such devices may advantageously comprise rolling fenders which simultaneously protect the vessel and the cargo from damage.

Accordingly it is an object of the invention to provide an improved transport ship for the transportation of floating vessels or floating cargo which includes at least one cargo space which may be selectively flooded or emptied of water and which includes a ballasting system permitting the vessel to be oriented or the dock chamber to be filled to a level which brings the level in the dock chamber equal to the level of the surrounding sea and wherein the vessels may be stacked in successive vertically arranged tiers by varying the liquid level in the cargo space during loading and positioning of the vessels and the unloading of such vessels.

A further object of the invention is to provide a method of loading floating cargo onto a ship having at least one cargo space which is closable by at least one openable cargo space door and having a ballast system permitting the flooding of the cargo space which comprises ballasting the vessel to flood the cargo space and to adjust the level of the water therein to the level of the sea, opening the cargo door to expose the cargo space to the sea and pushing the floating cargo into the cargo space and aligning it in the stowage position and thereafter ballasting the ship to move the cargo vertically in the cargo space in order to put it in a securing position arranged in a vertical tier, and thereafter adding additional tiers by regulating the draught of the vessel and the water level in the cargo space during the loading of each tier.

A further object of the invention is to provide a transport ship which has at least one cargo space which is closable by sea doors so that it may be separately filled and unfilled with liquid and which includes a ballasting system permitting the draught of the vessel to be changed and the level of the liquid in the cargo space to be changed in order to effect the floating in of successive tiers of cargo and their arrangement in the vertical tiers.

A further object of the invention is to provide a transport vessel which is simple in design, rugged in construction and economical to manufacture.

For an understanding of the principles of the invention, reference is made to the following description of typical embodiments thereof as illustrated in the accompanying drawing.

GENERAL DESCRIPTION OF THE PREFERRED EMBODIMENTS

Figure 1:
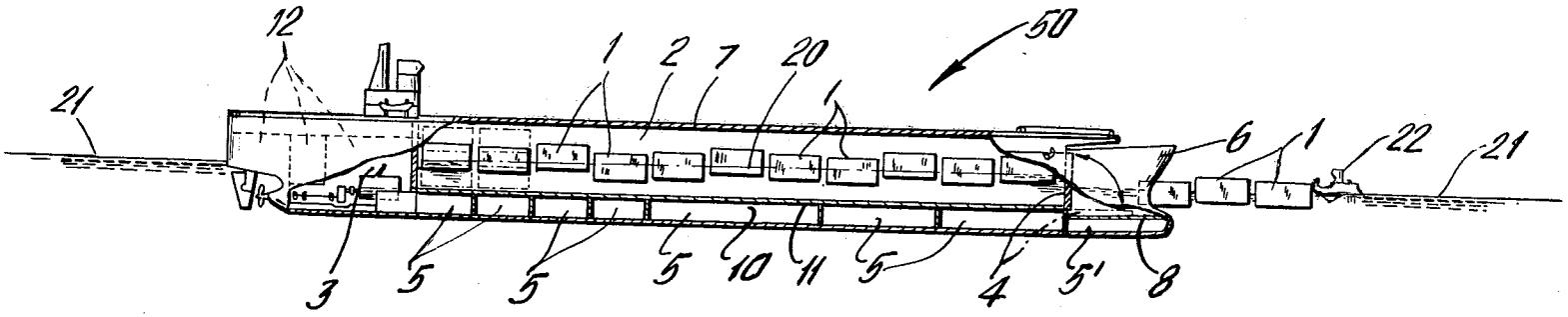
FIG. 1 is a longitudinal sectional view partly in elevation of a transport vessel having a cargo space for the floatable loading of two vertically arranged tiers of floating cargo or floating vessels constructed in accordance with the invention.

Referring to the drawings in particular, the invention embodied therein in FIG. 1 comprises a transport ship generally designated 50 which is designed for accommodating two vertically arranged tiers of floating vessels or floating pieces of cargo such as individual lighters or containers 1. In accordance with the invention the vessel includes a cargo chamber or dock chamber 2 which is not subdivided by transverse bulkheads and which extends from the front of the engine room 3 which is arranged in the after portion of the vessel all the way up to the fore portion of the vessel in the vicinity of the bow where it is closed by a dock gate or cargo space door 4. In the embodiment shown the dock gate is hinged on its lower end substantially even with the level 11 of the bottom of the cargo space 2. The vessel 50 includes a hull structure with spaced walls on each side and the bottom and it is subdivided into a plurality of individual floodable water ballast tanks 5. The forward portion of the ship's hull ahead of the dock gate 4 comprises two hinged fore body parts or a moveable body part 6 which hinge open toward the sides of the ship and which open under the force of gravity. The body parts 6 are subdivided in a center joint and extend from about the weather deck 7 to the tank top 8 of a forward tank portion 5' which is of a height which is lower than the remaining tank 5. The gate 4 is hinged so that it may be pivoted downwardly to a substantially horizontal position overlying the tank 5' and in this position its top surface will be level with the bottom 11 of the cargo space. The dock gate 4 can be opened after flooding of the dock chamber 2 and the space between the dock gate 4 and the body part 6 so as to form a roofed-in substantially U-shaped dock basin for the cargo or lighters 1 inside the ship. The dock gate 4 and the body part 6 constitute operable elements at the forward end of the cargo space which form sea door means.

The transport ship includes fittings which are not shown in detail which run through the water ballast tanks 5 and the dock gate 4 and which provide conduits for ballasting purposes. The dock chamber 2 as well as the space between the dock gate 4 and the body part 6 is controllably flooded or drained either from or to the surrounding sea through the conduits or fittings by the ship's own ballast system which may be connected from or to the water ballast tank 5 the space between the gate 4 and the body part 6 may be used to store self-propelled water craft for handling the cargo.

Figure 2:
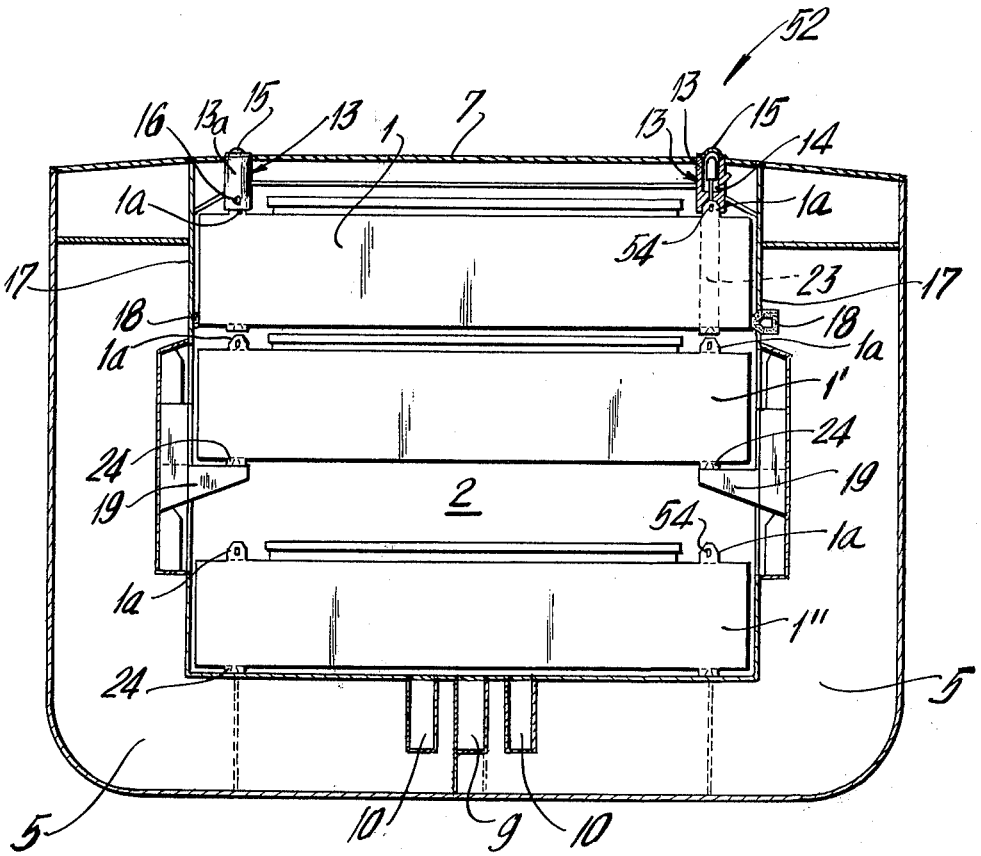
FIG. 2 is a transverse sectional view of a vessel similar to that shown in FIG. 1 but having an arrangement for loading three tiers of floatable cargo.

As indicated in the embodiment shown in FIG. 2 both the vessels shown in FIGS. 1 and 2 include a service alleyway or passage 9 and two vacuum flood tunnels 10, 10 which are arranged at each side of the ship's center line under the bottom 11 of the docking chamber 2 as shown in FIG. 2.

The vessel 50 includes additional ballast tanks 12 located around and aft of the engine room 3 which are provided for vessel trimming purposes.

In accordance with a feature of the invention the transport vessel includes a weather deck 7 above the docking chamber 2 which carries hanging devices or supporting members 13 in the form of cylinders 13a having a stepped bore 14 with a lower part of smaller diameter which widens in the form of a truncated pyramid downwardly. A mechanical visual indication device 15 is located in the cylinder **13*a* and heavy locking bolts 16 in the lower part of the cylinder are hydraulically insertable into matching openings which face each other for the purpose of securing each floatable container 1. For the lateral fixing of containers 1 inflatable stowage cushions or wedges 18 arranged in bulkhead walls or side walls 17 are provided which engage against the respective sides of the individual containers 1. Each container 1 is advantageously provided with an eyelet 1***a* through which the securing bolts of the hanging devices 13 extend in order to suspend the container 1 in the first or vertically uppermost tier. In respect to the vessel shown in FIG. 1 which only includes two tiers the lowermost tier may be positioned in a receiving portion of the cargo space and it may rest directly on a bottom 11.

The construction shown in FIG. 2 includes a vessel 52 which includes parts which are identical with that shown in FIG. 1 and the construction differs from that of FIG. 1 by the arrangement of positioning means for separating the cargo containers in the form of holding brackets or seats 19 which are carried in the side walls of the cargo space 2 and which may be moved out of the walls in order to provide a receiving cradle or support for an intermediate tier of containers 1' which are arranged directly above the uppermost tier of containers 1. The lowermost tier is indicated by containers 1'' in FIG. 2. The seats 19 may also be referred to as supporting members similar to the devices 13 inasmuch as each support cargo is above the first tier.

The loading procedure for the two tier ship shown in FIG. 1 is as follows:

With the ship trimming by the stern in the empty condition and with water ballast only in the ballast tanks 5 located in the forward portion of the ship water from the sea is let in into the docking chamber 2 to flood this chamber. At the same time it is preferable to flood the ballast tanks 12 by pumping water either from the sea or from those of the ballast tanks 5 located forward in the ship or by pumping from both locations simultaneously. During this controlled flooding procedure the ship will immerse deeper into the water and will incline forwardly until she floats on an approximately even keel and the interior water level 20 within the cargo space 2 is level with the exterior water level 21 outside the ship. The fore body parts 6 are then released so that they open outwardly and the deck gate 4 is permitted to drop downwardly to the horizontal position so that the docking chamber 2 is opened to the sea and the level therein is the same as the sea level. In some instances it may be necessary to add additional ballasting water to the ship in order to increase its draught for the inward movement of the floatable containers 1.

The floatable containers 1 are pushed from outside the vessel into the docking chamber 2 by push boats 22 either individually or arranged in groups of two or more which are connected together to form a unit. The loading of the containers 1 proceeds until a complete tier of containers or a desired part of the cargo is floated into the cargo space 2. In this position all of the individual containers 1 are fixed in a position by positioning devices (not shown) which are movable out of the side walls 17 of the dock chamber and which inhibit or prevent the movement of the individual containers in a fore and aft direction. A device of this nature may comprise a guide which is collapsible within a space within the double wall structure of the side of the vessel and which may be moved outwardly behind a cargo member and thus block its passage in a forward or aft direction.

After the first tier of lighters is floated into the dock chamber 2 the dock gate 4 is closed. The hinged fore body parts 6 will also be closed for example by means of the warping arrangement and then they are locked. The remaining space between the dock gate 4 and the fore body parts 6 is then drained of water. The level in the dock chamber is then regulated in order to position the upper tier into a position in which it will engage with the hanging devices 13. During this time the water may be pumped into the ballast tanks 12 and these tanks may also be filled by sea water from the exterior of the vessel as well as water from the ballast tanks 5. The dock chamber 2 requires additional water and it is possible to flood it with water obtained from the ballast tanks 5 only. Such a procedure has the advantage that when flooding the dock chamber 2 the lighters 1 in the chamber will be lifted on the water level 20 more quickly than the exterior water level 21 will rise in respect to the ship because of the water ballast which is taken on by the tanks 12.

When the water level inside the cargo space 2 rises the containers 1 will be moved upwardly to cause the truncated pyramid tops of their lifting posts 23 to engage into correspondingly constructed guides of the hanging devices 13. In doing so they automatically actuate mechanical visual indication devices 15 above the weather deck 7 to indicate that the containers 1 have arrived at their uppermost position. The lightest laden containers 1 will reach this position first and those which are most heavily laden will reach it last.

When all of the containers 1 have arrived in the upper position underneath the deck 7 they will be held as illustrated in FIG. 2 by four heavy locking bolts 16 which are pushed by means of hydraulically driven locking devices through openings 54 of eyelets 1*a* of lifting post elements 23. A similar procedure is employed in the handling of containers by means of a ship's crane in the case of transport ships which are presently known. The hung containers 1 will then be protected from possible deformation during navigation in stormy waters by additional lateral pressure at the bottoms of the lighters which is applied by means of inflatable stowage cushions 18. In the embodiment shown the second tier or the intermediate tier of containers 1' are secured by placing them on brackets or seats 19 which are movable out of the side walls or bulkheads 17 of the dock chamber 2. It is also possible to support the uppermost tier on supporting brackets 19 movable out of the side walls 17 of the dock chamber 2. The system of securing the lighters on the supports 19 is also applied with ships carrying more than two tiers of lighters for the tiers which are located between the uppermost and the bottom most tier.

After the upper tiers are all secured in a stowage position water is gradually-withdrawn from the chamber 2. This takes place by directing some of it into the ballast tanks 5 or into the intermediate space between the dock gate 4 and the fore body parts 6 or overboard as designed in order to bring the interior water level 20 in the dock chamber 2 back to the level of the water level 21 around the ship. After this the dock gate 4 and the fore body parts 6 are opened again and the next tier of lighters 1' will be floated in as described previously and then positioned in the fore and aft directions by dividing members (not shown). The dock gate 4 and the fore body parts 6 will then be closed again and the intermediate space between the dock gate 4 and the fore body parts 6 will be completely drained while the deck chamber 2 is ballasted again by the ship's own ballast system. When each container 1' is lifted up to in the proper position below the container 1 it is lowered onto its support 19 by lowering of the water level. The containers 1' are advantageously guided onto supports 24 which act to transmit the weight forces into the supporting structure. The lowermost tier of containers 1 is floated in as the previous tiers will be supported directly on the floor or bottom 11 and after the cargo space is finally drained the supporting structures 24 distribute the supporting force over this floor or bottom structure.

During the final drainage of the dock chamber 2 and of the space between gate 4 and the fore body parts 6 a push boat 22 may be docked and lashed on the forward double bottom 8 between the gate 4 and the fore body parts 6. The ship is then ready for departure.

The unloading procedure is performed in the opposite sequence. Loading of the vessel with more than two tiers of containers in accordance with the embodiment shown in FIG. 2 is performed in the same manner as the embodiment of FIG. 1 and the loading procedure is repeated for each tier.

Deviating from the procedure of loading with a two tier ship shown in FIG. 1, the positive guidance of the containers of the intermediate tier of a several tier ship like the three tier ship as shown in FIG. 2 during the water level rise in the cargo space 2 will be performed either by contact between the matching shapes of the lifting post 23 of the floated in tier and those of a tier hanging thereabove or by contact between tops of the lifting posts 23 of the containers 1' and the lower portion of supports 19 which advantageously have matching receiving recesses to engage. Position control of each container can be performed from an upper service alleyway which is situated in a side wall 17 of the dock chamber 2.

While specific embodiments of the invention have been shown and described in detail to illustrate the application of the principles of the invention, it will be understood that the invention may be embodied otherwise without departing from such principles.

What is claimed is:

1. A transport ship for the transportation of floating cargo such as a buoyant container, particularly barges, comprising a ship's hull having at least one vertically undivided plural tier cargo space with means in said cargo space for stowing containers in a plurality of tiers one above the other, said cargo space being capable of being flooded to float the cargo therein and to be drained and being communicable with the open sea to permit the floating in of buoyant cargo, said floating cargo being vertically movable within said cargo space from the level of the lowermost tier to the uppermost tier by flotation upon variations of the level of the water in the cargo space.

2. A transport ship for transporting floatable cargo comprising a hull having an engine room spaced aft with side and bottom walls having ballast tanks and having a vertically undivided plural tier cargo storage space forward of the engine room extending toward the bow, said cargo storage space having an opening toward the bow, a gate pivoted to said hull and closing said storage space opening, the space between said gate and the bow of the ship partially or fully being a removable body portion and defining a separate chamber between said cargo space and the forward end of the ship, said ship having its own ballasting system for ballasting said tanks and for flooding and draining said cargo space, said cargo space having storage means in said cargo space for securing floatable cargo at at least two tier levels.

3. A transport ship for transporting floatable cargo comprising a hull having an engine room spaced aft with side and bottom walls having ballast tanks and having a vertically undivided plural tier cargo storage space forward of the engine room extending toward the bow, said cargo storage space having an opening toward the bow, a gate pivoted to said hull and closing said storage space opening, the space between said gate and the bow of the ship partially or fully being a removable body portion and defining a separate chamber between said cargo space and the forward end of the ship, said ship having its own ballasting system for ballasting said tanks and for flooding and draining said cargo space, said cargo space having means for securing floatable cargo at at least two tier levels, said means for securing cargo at at least two tier levels including hanging means carried at the upper end of the cargo space for handing an upper tier of the cargo therefrom.

4. A transport ship for transporting floatable cargo comprising a hull having an engine room spaced aft with side and bottom walls having ballast tanks and having a vertically undivided plural tier cargo storage space forward of the engine room extending toward the bow, said cargo storage space having an opening toward the bow, a gate pivoted to said hull and closing said storage space opening, the space between said gate and the bow of the ship partially or fully being a removable body portion and defining a separate chamber between said cargo space and the forward end of the ship, said ship having its own ballasting system for ballasting said tanks and for flooding and draining said cargo space, said cargo space having means for securing floatable cargo at at least two tier levels, said means for securing at least two tiers or cargo including supporting brackets carried on each side of said cargo space extending into and being retractable out of said space and forming seats for receiving a tier of cargo.

5. A transport ship to claim 4, wherein said removable body parts in front of said cargo space gate, when in open position, form with their inner surface a bell mouth shaped guide for the cargo to be floated in, said guide being protected against damage by roll fenders or similar devices.

6. A transport ship for transporting floatable cargo comprising a hull having an engine room spaced aft with side and bottom walls having ballast tanks and having a vertically undivided plural tier cargo storage space forward of the engine room extending toward the bow, said cargo storage space having an opening toward the bow, a gate pivoted to said hull and closing said storage space opening, the space between said gate and the bow of the ship partially or fully being a removable body portion and defining a separate chamber between said cargo space and the forward end of the ship, said ship having its own ballasting system for ballasting said tanks and for flooding and draining said cargo space, said cargo space having means for securing floatable cargo at at least two tier levels, and means along the length of said cargo space for separating said floatable cargo into separate rows and for holding them against forward and after movement in said rows.

7. A transport ship for transporting floatable cargo comprising a hull having an engine room spaced aft with side and bottom walls having ballast tanks and having a vertically undivided plural tier cargo storage space forward of the engine room extending toward the bow, said cargo storage space having an opening toward the bow, a gate pivoted to said hull and closing said storage space opening, the space between said gate and the bow of the ship partially or fully being a removable body portion and defining a separate chamber between said cargo space and the forward end of the ship, said ship having its own ballasting system for ballasting said tanks and for flooding and draining said cargo space, said cargo space having means for securing floatable cargo at at least two tier levels, said means for securing said cargo into at least two tiers including hanging devices for hanging an uppermost tier, seats carried by said vessel for supporting intermediate tiers and securing means on the floor of said cargo space for supporting a lowermost tier.

8. A transport ship for transporting floatable cargo, comprising a hull, having at least one vertically undivided plural tier cargo space, a substantially horizontal cargo deck located at the bottom of said cargo space, a dock gate pivoted at its lower end to said cargo deck and being pivotal downwardly to open said cargo space, said hull having a bow forward of said dock gate with an openable hull part, said cargo space being floodable to permit the floating of cargo through said openable hull part and into said cargo space and being adjustable in level to permit the in- and off-loading of cargo in at least two distinct levels, with the first level of cargo being supportable on said cargo deck, and a supporting member carried by said hull at a level above the first cargo space tier for engaging and supporting the cargo in a tier above said first tier, there being three tier loading levels, said supporting member comprising a seat carried in said hull on at least one side of said cargo space engageable with an intermediate cargo tier, and a hanging device overlying the top of said cargo space and supporting the upper tier of cargo.

9. A transport ship for transporting floatable cargo, comprising a hull having a ballast system with ballast tank means and at least one vertically undivided plural vertical tier cargo space capable of being flooded and drained and having a space for a plurality of floatable cargo at each vertical tier level, and at least one sea door means for opening and closing said cargo space to the sea, said ballast system being capable of flooding and draining the entire cargo space and adjusting the ballast of said hull to bring the water level of the cargo space level with the surrounding sea so that when said sea door means are opened, the floatable cargo may be floated into the cargo space, the water level of said cargo space being adjustable with said sea door means closed to raise and lower said floatable cargo selectively to and between each of said tiers and said cargo space being unobstructed to permit the free raising and lowering of said cargo through the height of said cargo space, said vessel having cargo space stowage means in said cargo space for securing cargo which is floated into said cargo space at at least two separate tier levels.

10. A transport ship according to claim 9 wherein the lowermost tier of cargo is secured on the bottom of said cargo space.

11. A transport ship according to claim 9 wherein said sea door means comprises an opening to said cargo space and a gate pivoted on said hull and adapted to close said opening.

12. A transport ship according to claim 9 said stowage means including engagement means on each side of said cargo space for engaging the containers to protect them against transverse deformations by forces of seaway.

13. A device according to claim 12 wherein said engagement means for engaging each side of said container comprises mechanical wedges.

14. A transport ship according to claim 12 wherein said engagement means for engaging said containers on each side includes inflatable elastic hollow bodies.

15. A transport ship according to claim 9 wherein said sea door means comprises a gate closing said cargo space and being pivotal downwardly to open said space, said ship's hull having streamlined removable body parts in front of said gate.

16. A transport ship according to claim 15 wherein the space between said gate and said ship's body parts may be flooded and drained.

17. A transport ship according to claim 5 wherein said body parts are hollow.

18. A transport ship according to claim 9 including positioning means movable outwardly from recesses in said side walls for separating said containers after they are floated into the vessel in order to orient them within said cargo space for stowage.

19. A transport ship according to claim 9 including resilient means forming catching devices and carried on the sides of said cargo space for engaging containers moved therebetween to hold them in a position against fore and aft movement but being pressable back into said side walls of said cargo space upon the application of sufficient force to permit the held containers to be released and to be shifted to another holding location.

20. A transport ship according to claim 19 wherein said catching device parts protruding in resting position into the cargo space are of wedge shape.

21. A transport ship according to claim 20 wherein said catching devices are pressed into said cargo space by expanding compressible members.

22. A transport ship according to claim 19 wherein said catching devices are pressed into said cargo space by their own buoyancy in the dock chamber water or by their own gravity.

23. A transport ship for transporting floatable cargo, comprising a hull having a ballast system with ballast tank means and at least one vertically undivided plural tier cargo space capable of being flooded and drained, and at least one sea door means for opening and closing said cargo space to the sea, said ballast system being capable of flooding or draining the entire cargo space and adjusting the ballast of said hull to bring the water level of the cargo space level with the surrounding sea so that when said sea door means are opened the floatable cargo may be floated into said cargo space, said vessel having cargo space stowage means in said cargo space for securing cargo which is floated into said cargo space of at least two separate tier levels, said vessel including a deck overlying the cargo space, and cargo space stowage means for securing said cargo at at least two separate tiers including means at said deck for securing the uppermost tier therefrom.

24. A transport ship according to claim 23 including at least one hanging device supported on said deck for engagement with each container of the uppermost tier.

25. A transport ship for transporting floatable cargo, comprising a hull having a ballast system with ballast tank means and at least one vertically undivided plural tier cargo space capable of being flooded and drained, and at least one sea door means for opening and closing said cargo space to the sea, said ballast system being capable of flooding or draining the entire cargo space and adjusting the ballast of said hull to bring the water level of the cargo space level with the surrounding sea so that when said sea door means are opened the floatable cargo may be floated into said cargo space, said vessel having cargo space stowage means in said cargo space for securing cargo which is floated into said cargo space of at least two separate tier levels, said means for securing said containers in at least two tiers including removable brackets forming seats supported on the side walls of said cargo spaces for supporting each container at a selected tier height.

26. A transport ship for transporting floatable cargo, comprising a hull having a ballast system with ballast tank means and at least one vertically undivided plural tier cargo space capable of being flooded and drained, and at least one sea door means for opening and closing said cargo space to the sea, said ballast system being capable of flooding or draining the entire cargo space and adjusting the ballast of said hull to bring the water level of the cargo space level with the surrounding sea so that when said door means are opened the floatable cargo may be floated into said cargo space, said vessel having cargo space stowage means in said cargo space for securing cargo which is floated into said cargo space of at least two separate tier levels, said sea door means comprising a gate closing said cargo space and being pivotal downwardly to open said space, said ship's hull having streamlined removable body parts in front of said gate, said body parts comprising a hinged element on each side of the forward end of said hull being hinged to said hull to open outwardly on each side, the hinge being such that the body parts open by gravity when they are unlocked.

27. A transport ship for transporting floatable cargo, comprising a hull, having at least one vertically undivided plural tier cargo space, a substantially horizontal cargo deck located at the bottom of said cargo space, a dock gate pivoted at its lower end to said cargo deck and being pivotal downwardly to open said cargo space, said hull having an openable bow forward of said dock gate with an openable hull part, said cargo space being floodable to permit the floating of cargo through said openable hull part and into said cargo space and the entire cargo space being adjustable in water level to permit the in and off-loading of cargo into at least two distinct levels, with the first level of cargo being supportable on said cargo deck, and a supporting member in said cargo space carried by said hull at a level above the first cargo space tier for engaging and supporting the cargo in a tier above said first tier, a weather deck above said cargo deck closing said cargo space, said supporting member comprising a hanging device which hangs downwardly from said weather deck and is engageable with the cargo to hold the cargo in a tier above said first tier.

28. A transport ship for transporting floatable cargo, comprising a hull, having at least one vertically undivided plural tier cargo space, a substantially horizontal cargo deck located at the bottom of said cargo space, a dock gate pivoted at its lower end to said cargo deck and being pivotal downwardly to open said cargo space, said hull having an openable bow forward of said dock gate with an openable hull part, said cargo space being floodable to permit the floating of cargo through said openable hull part and into said cargo space and the entire cargo space being adjustable in water level to permit the in- and off-loading of cargo into at least two distinct levels, said cargo space being of a size to accommodate a plurality of floatable cargo and being adjustable in water level with said dock gate closed to raise and lower the cargo selectively to and between all of said tiers, one tier level of the cargo being supportable on said cargo deck, and a supporting member in said cargo space carried by said hull at a level above said one tier level for engaging and supporting the cargo in a higher tier.

29. A transport ship for transporting floatable cargo, comprising a hull, having at least one vertically undivided plural tier cargo space, a substantially horizontal cargo deck located at the bottom of said cargo space, a dock gate pivoted at its lower end to said cargo deck and being pivotal downwardly to open said cargo space, said hull having a bow forward of said dock gate with an openable hull part, said cargo space being floodable to permit the floating of cargo through said openable hull part and into said cargo space and being adjustable in level to permit the in- and off-loading of cargo into at least two distinct levels, one tier level of cargo being supportable on said cargo deck, said cargo space being of a size to accommodate a plurality of floatable cargo and being adjustable in water level with said dock gate closed to raise and lower the cargo selectively to and between all of said tiers, and a supporting member carried by said hull at a level above the one tier for engaging and supporting the cargo in a higher tier above said one tier, said supporting member comprising a seat, said seat being mounted in said hull along at least one side of said cargo space and being positionable below a cargo at a tier above said tier to support the cargo above said first tier.

30. A method of loading floating cargo containers onto a ship having a vertically undivided plural tier cargo space with each tier having space for a plurality of containers which may be arranged longitudinally one behind the other therein and which is closeable by an openable cargo space door and which has a ballast system permitting the flooding of the cargo space, comprising adjusting the level of the water in the cargo space to the level of the sea, opening the cargo door to expose the cargo space to the sea, pushing the floating cargo into the cargo space and aligning each of a plurality of separate cargo containers longitudinally in stowage positions one behind the other along the length of the cargo space, regulating the water level in the cargo space to adjust the cargo vertically and to shift it selectively to any one of the tiers, including moving the cargo on the water level through a tier level, if necessary, in order to position the cargo in a selected tier after the cargo space door has been closed, securing the cargo in a selected tier, thereafter adjusting the water level in the cargo space to a level which is different from the selected level and a level which corresponds to the sea level, pushing in another tier of a plurality of separate floating cargo containers into the cargo space and aligning them longitudinally in stowage positions, and closing the door and regulating the water level in the cargo space to position the other tier at a second tier stowage level, securing the cargo at the second tier stowage level and thereafter discharging the water from the cargo space.

31. A method according to claim 30 wherein the floating cargo is moved vertically in the ship by ballasting the ship to raise it or lower it in respect to the sea water level while the cargo space water is in communication with the water of the sea.

32. A method according to claim 30 wherein the cargo is movable vertically in the vessel by regulating the height of liquid in the cargo space while it is closed to the sea.

33. A method according to claim 30 wherein the cargo space is flooded from and drained into the water ballast tanks of said ship.

34. A method according to claim 30 wherein the cargo space is flooded from and drained into surrounding sea.

35. A method according to claim 30 wherein the vessels are moved into or out of the cargo space by self propelled small water craft.

* * * * *